US009821207B2

(12) United States Patent
Jewett

(10) Patent No.: US 9,821,207 B2
(45) Date of Patent: Nov. 21, 2017

(54) GOLF TRAINING APPARATUS

(71) Applicant: Jess Jewett, Providence, UT (US)

(72) Inventor: Jess Jewett, Providence, UT (US)

( * ) Notice: Subject to any disclaimer, the term of this patent is extended or adjusted under 35 U.S.C. 154(b) by 0 days.

(21) Appl. No.: 15/453,554

(22) Filed: Mar. 8, 2017

(65) Prior Publication Data

US 2017/0259146 A1 Sep. 14, 2017

Related U.S. Application Data

(60) Provisional application No. 62/305,426, filed on Mar. 8, 2016.

(51) Int. Cl.

| | |
|---|---|
| ***A63B 69/36*** | (2006.01) |
| ***A63B 69/00*** | (2006.01) |
| *A63B 102/32* | (2015.01) |

(52) U.S. Cl.

CPC ..... *A63B 69/0059* (2013.01); *A63B 2102/32* (2015.10); *A63B 2208/0204* (2013.01)

(58) Field of Classification Search

CPC ..... A63B 69/00; A63B 69/0059
USPC ..... 473/212–226, 257, 266, 276
See application file for complete search history.

(56) References Cited

U.S. PATENT DOCUMENTS

| | | | | |
|---|---|---|---|---|
| 4,193,065 | A * | 3/1980 | Bittner | A63B 69/3608 340/321 |
| 5,895,326 | A * | 4/1999 | Cozza | A63B 69/3608 473/213 |
| 6,413,196 | B1 * | 7/2002 | Crowson | A63B 21/153 273/317 |
| 6,852,067 | B2 * | 2/2005 | Limonadi | A61B 5/1125 400/704 |
| 7,766,757 | B2 * | 8/2010 | Brooks | A63B 69/0059 473/215 |
| 9,254,216 | B2 * | 2/2016 | Limonadi | A61F 5/013 |
| 2009/0176592 | A1 * | 7/2009 | Sery | A63B 69/3608 473/213 |
| 2011/0183769 | A1 * | 7/2011 | Sery | A63B 69/3608 473/213 |
| 2012/0157263 | A1 * | 6/2012 | Sivak | G06F 3/014 482/4 |

OTHER PUBLICATIONS

Impactsnap Training Video; published Nov. 3, 2015; Martin Nowicki; www.impactsnap.com;https://www.youtube.com/watch?v=GBiNQ40Wizo.

* cited by examiner

*Primary Examiner* — Nini Legesse
(74) *Attorney, Agent, or Firm* — Knobbe Martens Olson & Bear LLP

(57) ABSTRACT

An apparatus for golf training includes a wrist strap and a ring which are shaped and sized to be worn by a user. A cable extends between the wrist strap and the ring, and certain movements thereof are configured to provide an indication of improper swing form using an audible stimulus.

19 Claims, 4 Drawing Sheets

GOLF TRAINING APPARATUS

BACKGROUND OF THE INVENTION

Field of the Invention

This disclosure relates generally to the field of athletic training, and more particularly to golf swing training devices and procedures.

Description of the Related Art

When performing a golf swing, it is preferred that a golfer maintains a wrist break during the backswing, in which the golfer positions the club at the top of the swing path prior to initiating the downswing, in which the golfer swings the club to hit a golf ball. As the golfer performs the downswing, the wrist break should be maintained until the hands and grip of the club are positioned roughly vertically above the golf ball. At this point, the wrists should be released, or straightened, to exert power at the point of impact with the golf ball. A common mistake made by inexperienced golfers is "casting" of the golf club, or premature release of the wrists, causing a loss of power.

SUMMARY OF THE INVENTION

In accordance with one aspect of the present invention, athletic training devices are presented.

In one embodiment, an athletic training device includes a strap configured to be placed on a first body part, a housing attached to the strap, wherein the housing comprises an audible indicator, a ring configured to be placed on a second body part, and a cable extending between the housing and the ring, wherein at least some movements of the cable activate the audible indicator.

DETAILED DESCRIPTION OF THE PREFERRED EMBODIMENT

The present invention provides an apparatus and methods for golf swing training. One aspect of the invention includes a training device which is shaped and sized to be worn by a user and to provide an indication to the user of improper swing form.

Figure 1:
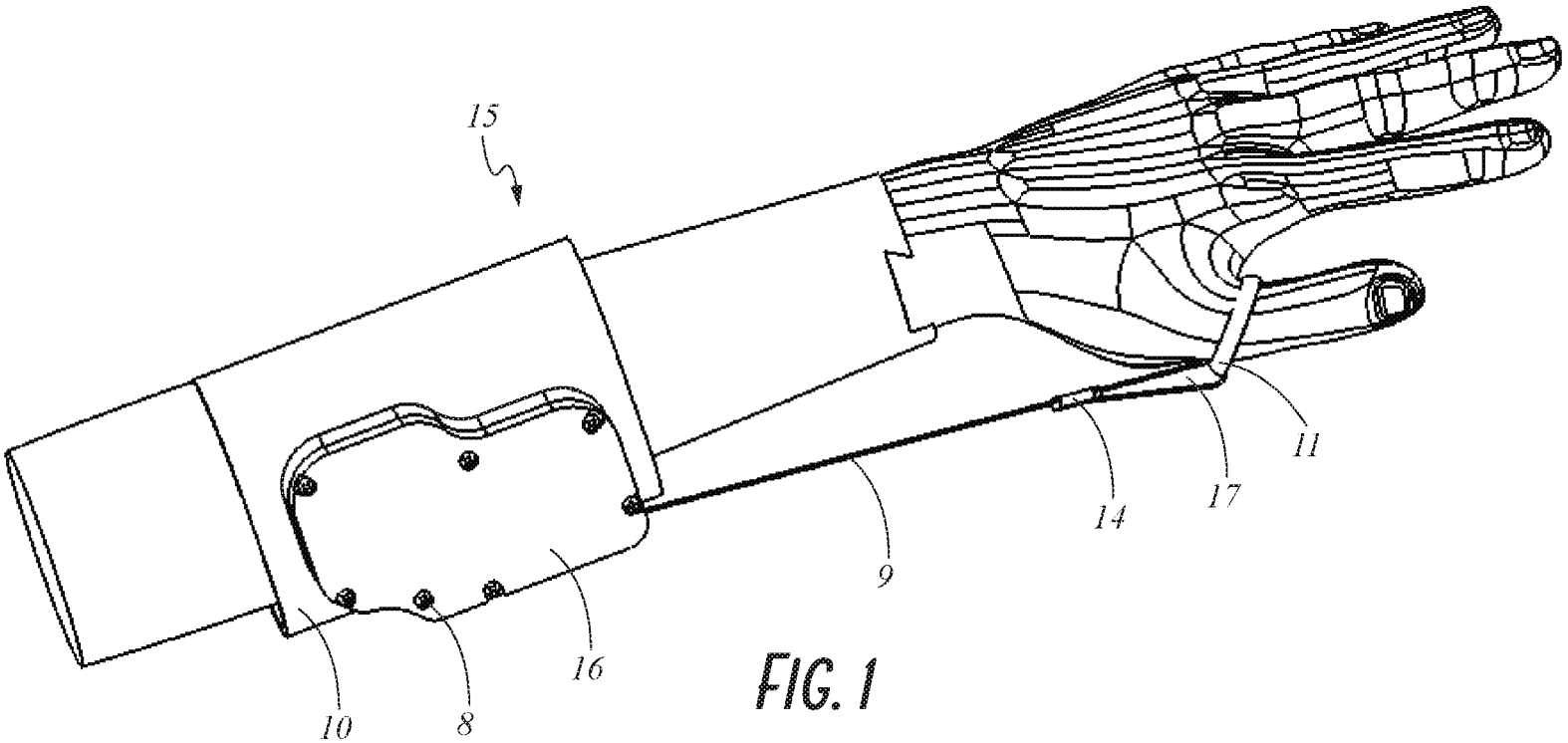
FIG. 1 depicts a perspective view of a training device 15 applied to an arm of a user.

FIG. 1 depicts a perspective view of a training device 15 applied to an arm of a user. The training device 15 includes a wrist strap 10, a housing 16, a plurality of fasteners 8, a string or cable 9, a connector 14, a string or cable 17, and a ring 11.

The wrist strap 10 is configured to be worn on the right or left forearm of a user depending on whether the user employs a "right-handed" swing (one in which the right foot is positioned behind the left foot with reference to the direction at which a golf ball is to be hit, and in which the right hand is positioned on the shaft of the golf club closer to the head of the golf club than the left hand) or "left-handed" swing. FIG. 1 shows an embodiment in which the training device 15 is attached to the right forearm of a golfer with a right-handed swing. In some embodiments, the wrist strap 10 is made of an elastic material. The wrist strap 10 can be deformable such that a user's hand may be placed through an opening in the wrist strap 10. The elasticity of the wrist strap 10 may further allow for the wrist strap to hold securely to a user's skin when in position on the forearm. The interior surfaces of the wrist strap 10 may include a material that facilitates friction between the wrist strap 10 and the skin to restrict movement of the wrist strap 10 with respect to the skin of the user. The interior surface may also be textured so as to restrict movement of the wrist strap 10 with respect to the skin of the user. In some embodiments, the wrist strap 10 may include one or more tightening mechanisms. For example, the wrist strap 10 may include laces, bands, belts, buttons, hook and loop fasteners, or any other complementary fastening surfaces.

Attached to the wrist strap 10 is a housing 16. Extending from the housing 16 is the cable 9. As will be discussed in further detail below, the cable 9 is retractable into the housing 16. At a distal end of the cable 9 with respect to the housing 16, the cable 9 is coupled to the connector 14. The connector 14 is further coupled to the cable 17. The cable 17 is also coupled to the ring 11. The ring 11 is shaped and sized to fit over a thumb of the user. However, the ring 11 may be shaped or sized to fit over any finger. The training device 15 can be positioned so that the cable 9 and cable 17 are in tension when the ring 11 is positioned on a user's thumb, such that certain movements of the user's thumb may result in movement of the cable 9 into or out of the housing 16. In some embodiments, the length of the cable 9 or the cable 17 may be adjustable. In some embodiments, the extent to which the cable 9 can extend out of the housing 16 can be adjustable. As will be described in further detail below, the training device 15 can include a stimulus mechanism so that movement of the cable 9 can cause a stimulus perceivable to a user to be produced.

In some embodiments, extension of at least a particular length of the cable 9 out of the housing 16 can cause an audible stimulus to be produced. For example, in some embodiments, an audible stimulus may be produced due to the movement of the cable 9 in response to movement of a user's wrist from a first position to a second position. A first position may be one in which a long axis of a user's thumb, while grasping a golf club and being approximately parallel to the long axis of the shaft of the golf club, is positioned to be approximately perpendicular to the long axis of the user's forearm. A second position may be one in which the long axis of the user's thumb, while grasping a golf club and being approximately parallel to the long axis of the shaft of the golf club, is positioned to be approximately parallel to the long axis of the user's forearm with the tip of the thumb pointing away from the wrist. In some embodiments, the first position is indicative of a preferred position of a user's wrist when in the top position of the golf swing prior to beginning the downswing and the second position is indicative of a preferred position of the user's wrist at the point of impact or immediately before the point of impact with the golf ball during the user's downswing.

Figure 2:
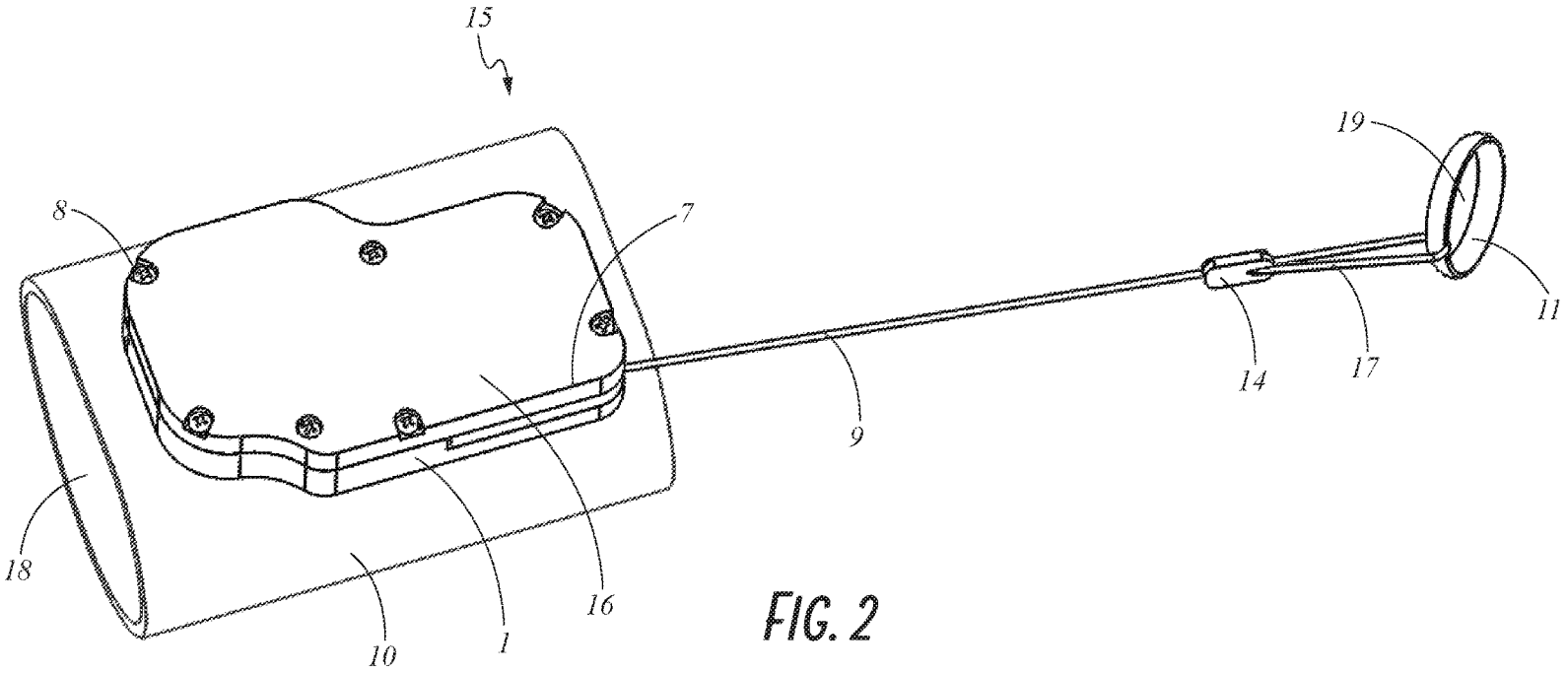
FIG. 2 shows a perspective view of the training device 15.

FIG. 2 shows a perspective view of the training device 15. FIG. 2 shows an opening 18 for receiving a hand and arm of a user and an opening 19 for receiving a finger of the user, such as the thumb. The housing 16 includes a bottom housing 1 and a top housing 7. The fasteners 8 are configured to secure the top housing 7 to the bottom housing 1.

Figure 3:
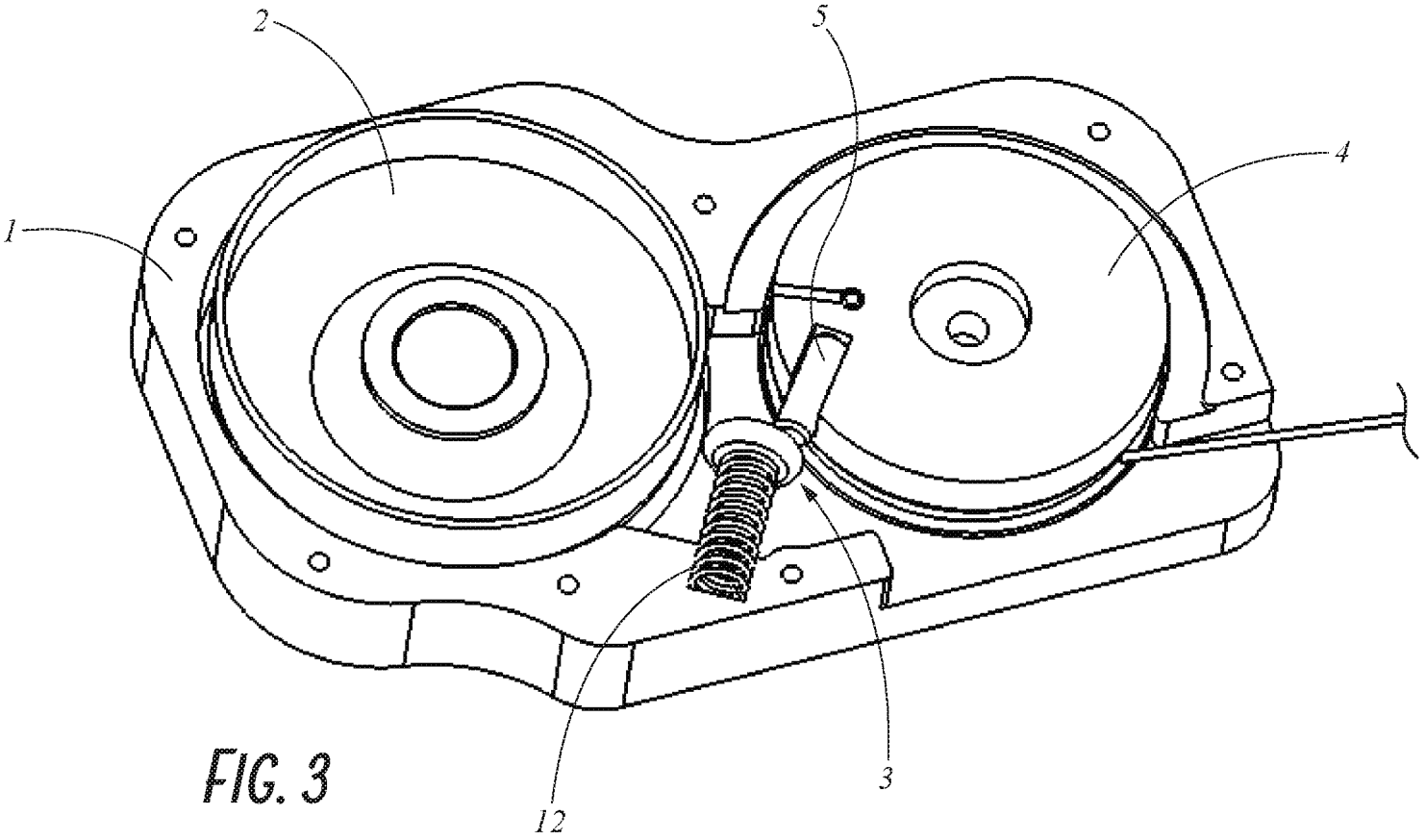
FIG. 3 shows a perspective view of several interior components of the housing 16.

FIG. 3 shows a perspective view of several interior components of the housing 16. FIG. 3 shows the interior of the bottom housing 1. Positioned within the bottom housing 1 are the bell 2, the pulley 4, the striker 5, the hammer 3, and the spring 12. As shown in FIG. 3, the cable 9 is connected to the pulley 4 and can wrap around the exterior surface thereof. The pulley 4 is capable of rotational movement such that movement of the cable 9 away from the bottom housing 1 causes rotation of the pulley 4. Movement of the cable 9 away from the bottom housing 1 can cause counterclockwise movement of the pulley 4. In some embodiments, the pulley 4 is biased, such that, if an external force applied to the cable 9 is released, the pulley 4 will rotate in a clockwise direction to at least partially retract the cable 9 into the bottom housing 1. A torsion spring 13 (shown in FIG. 4) is positioned below the pulley 4. The torsion spring 13 can be responsible for biasing the pulley 4 and causing the pulley 4 to reset in the absence of an external force being exerted on the pulley 4. A proximal end of the striker 5 is affixed within the pulley 4 such that movement of the pulley 4 causes movement of the striker 5 around an axis of rotation of the pulley 4. At least a portion of the distal end of the striker 5 extends radially beyond a circumference of the pulley 4. The spring 12 is secured at a proximal end to an interior surface of the bottom housing 1. The hammer 3 is affixed to the distal end of the spring 12. When the spring 12 is in an unstressed position, the hammer 3 is positioned within the interior of the bottom housing 1 so that the distal end of the striker 5 can contact a surface of the hammer 3 at least one position when rotating about the axis of rotation of the pulley 4. The training device 15 is configured so that contact between the striker 5 and the hammer 3, when the pulley is rotating in the counterclockwise direction, causes the hammer 3 to move away from the bell 2 in at least one direction, stressing the spring 12 in at least one direction. The striker 5 and hammer 3 are further spaced and positioned so that further rotation of the pulley 4 can cause the striker 5 to move beyond the hammer 3, releasing the hammer 3 from contact with the striker 5. When the hammer 3 is released from the striker 5, the spring 12 can cause the hammer 3 to move towards the bell 2, striking the bell 2 and producing an audible stimulus.

As described above, movement of the cable 9 can be caused by movement of a user's wrist from a first position to a second position. Consequently, movement of the user's wrist from the first position to the second position can cause counterclockwise rotation of the pulley 4, causing the striker 5 to move the hammer 3 and then release the hammer 3, causing the hammer 3 to strike the bell 2. In alternative embodiments, bell 2 can be replaced with any audible indicator. In alternative embodiments, movement of the cable 9 can produce a visual or tactile stimulus.

In some embodiments, an electronic audible emitter can produce an audible stimulus in addition to or instead of the bell 4. In some embodiments, the housing 16 can include an electronic switch, such as a microswitch. The electronic switch can be in communication with the electronic audible emitter. In some embodiments, the electronic audible emitter can be configured to produce an audible stimulus in response to activation of the electronic switch. In some embodiments, the training device 15 further includes a lever configured to activate the electronic switch in response to movement of the cable 9. The lever can be coupled to the pulley or the cable. In some embodiments, the lever is positioned against the electronic switch when in a first position and releases the electronic switch when moved to a second position. In some embodiments, release of the electronic switch is configured to cause activation of the electronic audible emitter.

In some embodiments, the housing 16 can include a sensor in connection with the electronic audible emitter. The sensor can be configured to detect movement of one or more of the pulley 4 and the cable 9. In some embodiments, the electronic audible emitter can be configured to produce an audible stimulus in response to a reading or measurement of the sensor. For example, the electronic audible emitter can be configured to emit an audible stimulus in response to detection of a movement or amount of movement by one or more of the pulley 4 and the cable 9. The sensor can be a linear or rotary motion sensor. In some embodiments, the sensor is a rotary to linear encoder.

Figure 4:
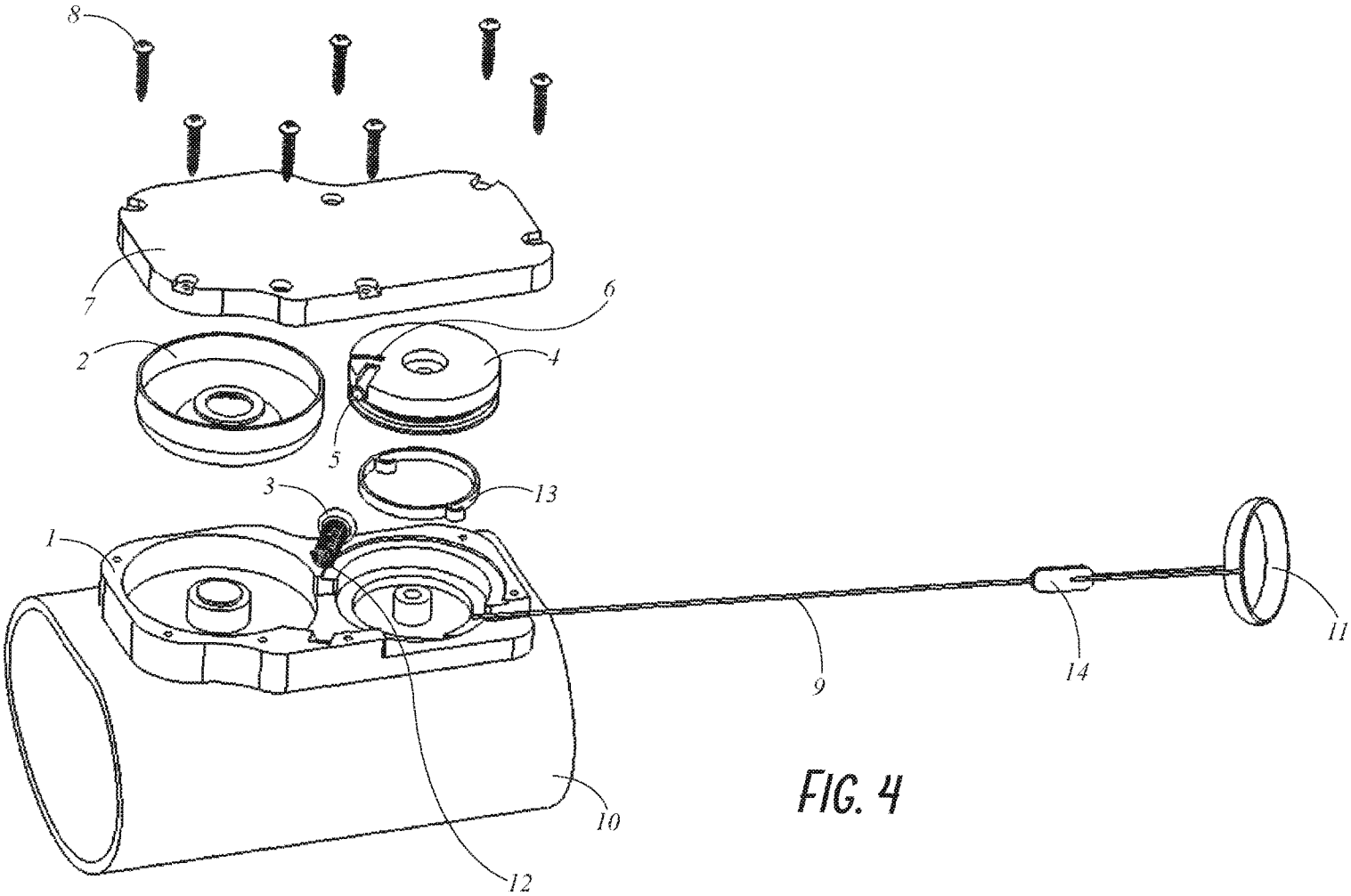
FIG. 4 shows an exploded view of the training device 15.

FIG. 4 shows an exploded view of the training device 15 showing the bottom housing 1, bell 2, hammer 3, pulley 4, striker 5, a spring catch pin 6, top housing 7, a plurality of fasteners 8, cable 9, wrist strap 10, ring 11, spring 12, a torsion spring 13, connector 14, and cable 17. The spring catch pin 6 is configured to hold the torsion spring 13 in place within the training device 15.

The training device 15, described above with respect to FIGS. 1-4, can be sued in methods for swinging a golf club, which may include the following steps. First, the wrist strap 10 may be placed on a user's forearm. Following placement of the wrist strap 10 on the user's forearm, the ring 11 can be placed on the user's thumb. After placement of the ring 11 on the user's thumb, one or more of the placement of the wrist strap 10, the length of the cable 9, the length of the cable 17, or the extent of the cable 9 capable of extending out of the housing 16 can be adjusted so that an audible stimulus produced by the hammer 3 striking the bell 2 will be produced at a preferred orientation of the user's wrist and/or thumb. Following, adjustment of the training device 15, the user can begin performance of a golf swing. After beginning performance of the golf swing, the user can change the orientation of the user's wrist, causing the audible stimulus to be produced.

Various other modifications, adaptations, and alternative designs are of course possible in light of the above teachings. Therefore, it should be understood at this time that within the scope of the appended claims the invention may be practiced otherwise than as specifically described herein. It is contemplated that various combinations or subcombinations of the specific features and aspects of the embodiments disclosed above may be made and still fall within one or more of the inventions. Further, the disclosure herein of any particular feature, aspect, method, property, characteristic, quality, attribute, element, or the like in connection with an embodiment can be used in all other embodiments set forth herein. Accordingly, it should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments described above. Moreover, while the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents, and alternatives falling within the spirit and scope of the various embodiments described and the appended claims. Any methods disclosed herein need not be performed in the order recited. The methods disclosed herein include certain actions taken by a practitioner; however, they can also include any third-party instruction of those actions, either expressly or by implication. The ranges disclosed herein also encompass any and all overlap, sub-ranges, and combinations thereof. Language such as "up to," "at least," "greater than," "less than," "between," and the like includes the number recited. Numbers preceded by a term such as "approximately", "about", and "substantially" as used herein include the recited numbers (e.g., about 10%=10%), and also represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount.

What is claimed is:

1. An athletic training device, comprising:

a strap configured to be placed on a forearm of a user;

a housing attached to the strap;

an audible indicator coupled to the housing;

a ring configured to be placed on a thumb of the user; and a cable extending between the housing and the ring, wherein at least some movements of the cable activate the audible indicator;

wherein the audible indicator is configured to activate in response to movement of a wrist of the user from a first position in which a long axis of the thumb of the user while grasping a golf club is parallel to a long axis of the shaft of the golf club and perpendicular to a long axis of the forearm of the user to a second position in which the long axis of the thumb of the user while grasping the golf club is parallel to the long axis of the shaft of the golf club and parallel to the long axis of the forearm of the user.

2. The athletic training device of claim 1, wherein the audible indicator is an electronic audible emitter.

3. The athletic training device of claim 1, further comprising a lever coupled to the cable, wherein at least some movements of the cable are configured to cause movement of the lever.

4. The athletic training device of claim 3, further comprising an electronic switch coupled to the audible indicator, wherein the electronic switch is configured to activate in response to at least some movements of the lever.

5. The athletic training device of claim 1, wherein the audible indicator is configured to activate in response to movement of the ring from a first distance relative to the housing to a second distance relative to the housing, the second distance greater than the first distance.

6. The athletic training device of claim 5, wherein one or more of the first distance and the second distance are adjustable.

7. The athletic training device of claim 6, wherein the configuration of one or both of the cable and the lever within the housing can be adjusted to adjust one or both of the first distance and the second distance.

8. The athletic training device of claim 1, wherein the cable is secured to a pulley such that at least some movements of the cable cause movement of the pulley.

9. The athletic training device of claim 8, further comprising a lever secured to the pulley, the lever extending beyond a circumference of the pulley.

10. The athletic training device of claim 9, wherein at least some movements of the pulley cause the lever to activate an electronic switch in communication with the audible emitter.

11. A method for performing a golf swing using the athletic training device of claim 1, the method comprising:

attaching the strap to the forearm of the user;

attaching the ring to the thumb of the user; and positioning the golf club at a top position of the golf swing with the wrist in the first position;

performing a downswing of the golf club to activate the audible indicator.

12. The method of claim 1, further comprising adjusting a length of the cable extending between the housing and the ring such that movement of the wrist from the first position to the second position causes activation of the audible indicator.

13. An athletic training device, comprising:

a housing configured to be coupled to a forearm of a user;

a cable at least partially positioned within the housing, the cable being extendable from the housing and coupled to a thumb of the user;

an indicator coupled to the housing, wherein extension of the cable over a defined distance from the housing activates the indicator, wherein the defined distance corresponds to movement of a wrist of the user from a first position in which a long axis of the thumb of the user while grasping a golf club is parallel to a long axis of the shaft of the golf club and perpendicular to a long axis of the forearm of the user to a second position in which the long axis of the thumb of the user while grasping the golf club is parallel to the long axis of the shaft of the golf club and parallel to the long axis of the forearm of the user.

14. The athletic training device of claim 13, wherein the indicator is one or more of an audible indicator, a visual indicator, and a tactile indicator.

15. The athletic training device of claim 14, wherein the indicator is an electronic audible emitter.

16. The athletic training device of claim 13, wherein the cable comprises a first end positioned within the housing and a second end coupled to the thumb of the user.

17. The athletic training device of claim 13, wherein the defined distance is adjustable.

18. The athletic training device of claim 13, further comprising a lever coupled to the cable, wherein extension of the cable over the defined distance is configured to cause movement of the lever to activate an electronic switch.

19. The athletic training device of claim 18, wherein the electronic switch is configured to activate in response to a release of the electronic switch.

* * * * *